US011758967B2

(12) United States Patent
Ellison et al.

(10) Patent No.: US 11,758,967 B2
(45) **Date of Patent: *Sep. 19, 2023**

(54) ENDURO MOUNTAIN BIKING CHIN BAR

(71) Applicant: BELL SPORTS, INC., Scotts Valley, CA (US)

(72) Inventors: Erin Kyle Ellison, Felton, CA (US); Eamon Briggs, Santa Cruz, CA (US); Benjamin Warren Penner, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/408,254

(22) Filed: Aug. 20, 2021

(65) Prior Publication Data

US 2021/0378347 A1 Dec. 9, 2021

Related U.S. Application Data

(63) Continuation of application No. 16/365,564, filed on Mar. 26, 2019, now Pat. No. 11,129,432, which is a continuation of application No. 14/642,287, filed on Mar. 9, 2015, now Pat. No. 10,238,165.

(60) Provisional application No. 61/949,534, filed on Mar. 7, 2014.

(51) Int. Cl.
*A42B 3/32* (2006.01)

(52) U.S. Cl.
CPC ..... *A42B 3/326* (2013.01)

(58) Field of Classification Search
CPC ..... A42B 3/326; A42B 3/066; A42B 3/205
See application file for complete search history.

(56) References Cited

U.S. PATENT DOCUMENTS 3,107,356 A 10/1963 Pestronk et al.
4,024,587 A 5/1977 Barford
(Continued)

FOREIGN PATENT DOCUMENTS

CA 2437626 C 2/2005
CA 2639076 C 7/2013
(Continued)

OTHER PUBLICATIONS

International Search Report and Written Opinion regarding International Application No. PCT/US15/19521; dated Aug. 13, 2015.
(Continued)

*Primary Examiner* — Alissa L Hoey
(74) *Attorney, Agent, or Firm* — Walter M. Egbert, III; Richard J. Brown; Reed Smith LLP

(57) ABSTRACT

A bicycle helmet system comprising a helmet and a chin bar is disclosed. The chin bar is removably coupled to the helmet and wrapped circumferentially around a portion of the helmet. The chin bar may include a rear buckle configured to tighten the chin bar around the helmet. The chin bar may also include two side buckles that engage with side recesses on the helmet when the chin bar is removably coupled to the helmet. The chin bar may also include two alignment protrusions positioned to engage with alignment recesses on the helmet when the chin bar is removably coupled to the helmet.

16 Claims, 6 Drawing Sheets

(56) References Cited

U.S. PATENT DOCUMENTS

| | | | | |
|---|---|---|---|---|
| 4,051,611 | A * | 10/1977 | Chalmers | A43C 11/1413 36/50.1 |
| 4,290,150 | A | 9/1981 | Guerre-Berthelot | |
| 4,598,430 | A | 7/1986 | Nava | |
| 5,621,923 | A | 4/1997 | Tapocik | |
| 5,787,513 | A | 8/1998 | Sharmat et al. | |
| 6,138,283 | A | 10/2000 | Kress | |
| 6,834,398 | B1 | 12/2004 | Martinez | |
| 7,207,071 | B2 | 4/2007 | Pierce | |
| 8,176,574 | B2 | 5/2012 | Bryant et al. | |
| 8,490,214 | B2 | 7/2013 | Crye | |
| 8,544,118 | B2 | 10/2013 | Brine, III et al. | |
| 8,793,816 | B2 | 8/2014 | Emrich et al. | |
| 9,241,527 | B2 * | 1/2016 | Croteau | F41H 1/04 |
| 9,339,083 | B2 * | 5/2016 | Benetti | A43C 11/144 |
| 9,439,470 | B2 * | 9/2016 | McGinn | F41H 11/04 |
| 9,439,471 | B2 | 9/2016 | Wehtje | |
| 9,655,398 | B2 * | 5/2017 | Zanchi | A42B 3/205 |
| 9,848,665 | B2 | 12/2017 | Gendron et al. | |
| 10,076,149 | B2 * | 9/2018 | Ross | A42B 3/18 |
| 10,238,165 | B2 | 3/2019 | Ellison et al. | |
| 10,492,559 | B1 | 12/2019 | Kele et al. | |
| 10,736,374 | B2 | 8/2020 | An et al. | |
| 2005/0120467 | A1 | 6/2005 | Desarmaux et al. | |
| 2009/0044314 | A1 | 2/2009 | Newman | |
| 2009/0044316 | A1 | 2/2009 | Udelhofen | |
| 2009/0178184 | A1 | 7/2009 | Brine et al. | |
| 2012/0117717 | A1 * | 5/2012 | McGinn | A42B 3/326 2/243.1 |
| 2012/0204328 | A1 | 8/2012 | Emrich et al. | |
| 2012/0284905 | A1 | 11/2012 | Kim | |
| 2013/0042396 | A1 | 2/2013 | Wehtje | |
| 2013/0067645 | A1 | 3/2013 | Musal et al. | |
| 2013/0219595 | A1 | 8/2013 | Musal | |
| 2013/0312162 | A1 | 11/2013 | Brine, III et al. | |
| 2014/0338105 | A1 | 11/2014 | Maier | |
| 2017/0112227 | A1 | 4/2017 | Pietrzak et al. | |
| 2017/0120134 | A1 * | 5/2017 | Warmouth | A42B 3/205 |
| 2017/0164679 | A1 * | 6/2017 | Schmitter | A42B 3/326 |
| 2017/0251742 | A1 * | 9/2017 | Partlo | F41H 1/04 |
| 2017/0318893 | A1 | 11/2017 | Durham et al. | |
| 2018/0092426 | A1 | 4/2018 | Hall et al. | |
| 2022/0218065 | A1 * | 7/2022 | Cohen | A42B 3/322 |

FOREIGN PATENT DOCUMENTS

| | | | |
|---|---|---|---|
| CN | 201873101 | U | 6/2011 |
| DE | 3214020 | A1 | 7/1983 |
| DE | 3308904 | A1 | 10/1983 |
| DE | 102011122796 | B4 | 8/2018 |
| EP | 1781131 | B1 | 1/2011 |
| ES | 2393747 | T3 | 12/2012 |
| FR | 2863149 | B1 | 6/2005 |
| RU | 2350236 | C2 | 3/2009 |
| WO | 2006005183 | A1 | 1/2006 |
| WO | 2006005184 | A1 | 1/2006 |
| WO | 2013097943 | A1 | 7/2013 |

OTHER PUBLICATIONS

Translation of Office Action and Search Report, regarding Chinese Patent Application No. 201580012227.0; dated May 31, 2018.

Translation of Chinese Office Action, regarding Chinese Patent Application No. 201580012227.0; dated Jun. 27, 2019.

Translation of Supplemental Chinese Search Report, regarding Chinese Patent Application No. 201580012227.0; dated Jan. 3, 2020.

European Partial Search Report, regarding European Patent Application No. 15759311.2; dated Aug. 9, 2017.

Supplemental European Search Report, regarding European Patent Application No. 15759311.2; dated Nov. 23, 2017.

Office Action regarding European Patent Application No. 15759311.2; dated Oct. 11, 2018.

* cited by examiner

ENDURO MOUNTAIN BIKING CHIN BAR

CROSS REFERENCE TO RELATED APPLICATIONS

This document is a continuation of U.S. Utility patent application Ser. No. 16/365,564, filed Mar. 26, 2019, entitled "ENDURO MOUNTAIN BIKING CHIN BAR", which is a continuation of U.S. patent application Ser. No. 14/642,287, filed Mar. 9, 2015, now U.S. Pat. No. 10,238,165, issued Mar. 26, 2019, which claims the benefit of U.S. Provisional Patent Application No. 61/949,534, filed Mar. 7, 2014, the contents of which are hereby incorporated herein by reference.

BACKGROUND

Technical Field

Aspects of this document relate generally to mountain biking helmets.

Background Art

Enduro mountain biking is a relatively new mountain biking racing format. The format includes multiple stages including timed downhills and untimed uphills. The competitor with the lowest overall time wins. Currently, many of the riders wear full-face helmets meaning the helmet has a chin bar.

Because enduro mountain biking is not as technically demanding as a pure downhill event and the downhill portions are a little less treacherous, a downhill certified helmet is not required. However, many riders choose to wear a downhill certified or full-face helmet because of the added safety features, in particular, a chin bar, which is found on all downhill certified helmets. As a general rule, downhill certified helmets are heavier than bike/mountain bike certified helmets. In addition to the added weight of a downhill certified helmet, they generally are hotter to wear because of the reduced number of ventilation ports and full-face enclosure.

Downhill certified helmets can be a tremendous burden when a rider is going uphill. Weight and heat build-up can tax a rider's energy and speed when climbing. Even though the uphill portions of an enduro are not timed, the rider still has to get to the top of the downhill ahead of a cut-off time and has to have the endurance to meet the physical and mental demands of the downhill. If a rider has to burn a lot of energy to get to the top/start of a timed portion, there won't be much left in the "tank" for the part that matters to overall placing.

In addition to getting down the timed portion as quickly as possible, a rider wants to have the confidence to know they'll arrive safely at the finish. Downhills are tricky and accidents happen. Riders want to be safe in the event of an accident. Having a chin bar affords an additional element of protection, which gives a rider confidence.

For the foregoing reasons, a number of helmet designs have been created on the market to include a removable chin bar that allows a rider to ride with the same helmet, with or without the chin bar, depending on the circumstances and conditions anticipated or encountered by the rider. For example, one helmet includes a bolt on chin bar that is attachable or detachably removed from the helmet with a tool, such as a screwdriver, Allen wrench, or other driving instrument, that secures the chin bar to the helmet. Bolt-on chin bars can be time intensive and unwieldy for users to attach or remove from the helmet, and can require more time to remove and replace the chin bar than with other detachable chin bar designs, such as the tool-less plastic connections.

Another mounting biking helmet includes a chin bar that attaches or plugs into the top portion of the helmet from below without the use of a tool. The attachable/detachable chin bar attaches to the helmet with a tab or flange that is inserted into a socket or sleeve configured to receive the tab or flange. The chin bar can be removed or released from the helmet by pressing or engaging two flexible tabs or buttons. Upon pressing the tabs, the chin bar can be slid downwards away from the helmet. Another biking helmet includes a chin bar that plugs into the helmet from below, and can be released from the helmet by engaging two buttons.

These helmet designs, while allowing for their respective chin bars to be attached and detached, depend primarily on plastic connections. The use of Vertical alignment features for attachment of chin bars to these helmet designs can make it difficult for a user to align the chin bar with the plastic connections on the helmet to allow the chin bar to be attached or detached, especially when the user is wearing the helmet. Due to the nature of enduro racing and a rider's need to attach and detach the chin bar for different points of a race, such as during uphill and downhill portions of a race, the difficulty of aligning the chin bar with the helmet for these helmets is inconvenient and undesirable for a rider. Additionally, these conventional removable chin bar helmet designs provide chin bars that have limited resistance to impacts that are not head-on impacts, such as impacts with a side portion or lower portion of the helmet and chin bar.

SUMMARY

In one aspect, a mountain biking helmet system may comprise a helmet and a chin bar removably coupled to the helmet and wrapped circumferentially around a portion of the helmet.

One or more particular embodiments of a mountain biking helmet system may comprise one or more of the following features. The chin bar may be wrapped circumferentially around a bottom portion of the helmet and the chin bar comprises a rear coupling configured to tighten the chin bar circumferentially around the helmet. The rear coupling may comprise a rear buckle. The chin bar may be wrapped circumferentially around a bottom portion of the helmet and the chin bar comprises two opposing side couplings configured to couple the chin bar circumferentially around the helmet. The two opposing side couplings may comprise two opposing side buckles, and wherein a portion of each of the two opposing side buckles engages a different one of two side recesses on the helmet when the respective buckle is in a closed position to couple the chin bar circumferentially around the helmet. The helmet may further comprise two front receivers and each of the two opposing side buckles further comprises a hook that engages with a different front receiver of the two front receivers on the helmet when the respective buckle is in the closed position. The chin bar further comprises two alignment protrusions engaged with two alignment recesses on the helmet. The helmet may further comprise two in-molded thermoplastic lower components, each of the two in-molded thermoplastic lower components surrounding a different one of the two side recesses of and a different one of the two alignment recesses.

In another aspect, a chin bar for a mountain biking helmet may comprise a front portion configured to cover a portion of an open front of a mountain biking helmet, a back portion configured to cover a portion of the mountain biking helmet, and one or more couplings configured to couple the chin bar to the mountain biking helmet such that the chin bar forms a continuous loop when the one or more couplings couple the chin bar to the mountain biking helmet and the chin bar wraps circumferentially around the mountain biking helmet.

One or more particular embodiments of a chin bar for a mountain biking helmet may comprise one or more of the following features. The one or more couplings may comprise at least a rear coupling on the back portion of the chin bar, the rear coupling operable between an open position and a closed position that reduces the circumference of the chin bar. The rear coupling may comprise a rear buckle. The one or more couplings may further comprise two side couplings, each one of the two side couplings configured to engage with a different side recess on the mountain biking helmet. The two side couplings may comprise two side buckles, each one of the two side buckles comprising a base configured to engage with a different side recess, a lever operable between an open position and a closed position, and a hook operably coupled to the lever such that movement of the lever from the open position to the closed position draws the hook closer to the base, the hook being configured to engage a front receiver on the mountain biking helmet when the lever is in the closed position. Two alignment protrusions on the back portion of the chin bar, the alignment protrusions being positioned and configured to engage with two alignment recesses on the mountain biking helmet.

In another aspect, a mountain biking helmet system may comprise a helmet comprising an outer surface, two side recesses, and two alignment recesses, and two in-molded thermoplastic lower components on the outer surface of the helmet, each of the two in-molded thermoplastic lower components surrounding a different one of the two side recesses and a different one of the two alignment recesses.

One or more particular embodiments of a mountain biking helmet system may comprise one or more of the following features. A chin bar configured to removably couple to the helmet and wrap circumferentially around a portion of the helmet. The chin bar may be wrapped circumferentially around a bottom portion of the helmet and the chin bar comprises a rear buckle configured to tighten the chin bar circumferentially around the helmet. Two opposing side buckles, wherein a base of each of the two opposing side buckles may engage a different one of the two side recesses when the respective buckle is in a closed position and the chin bar is coupled circumferentially around the helmet. The helmet may further comprise two front receivers and each of the two opposing side buckles further comprises a hook that engages with a different one of the two front receivers on the helmet when the respective buckle is in the closed position. The chin bar may further comprise two alignment protrusions positioned to engage with the two alignment recesses when the chin bar is coupled circumferentially around the helmet.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation and/or assembly procedures for an enduro mountain biking chin bar will become apparent for use with implementations of enduro mountain biking chin bars from this disclosure. Accordingly, for example, although particular helmets and chin bars are disclosed, such helmets and chin bars and implementing components may comprise any shape, size, style, type, model, version, measurement, concentration, material, quantity, and/or the like as is known in the art for such helmets and enduro mountain biking chin bars and implementing components, consistent with the intended operation of an enduro mountain biking chin bar.

A removable chin bar is disclosed herein that overcomes many of the drawbacks and hazards in enduro mountain biking that arise both from riding with a downhill certified helmet with its associated chin bar and from riding without a chin bar at all. In addition, embodiments of the removable chin bar disclosed herein improves upon conventional removable chin bar helmets.

Figure 1:
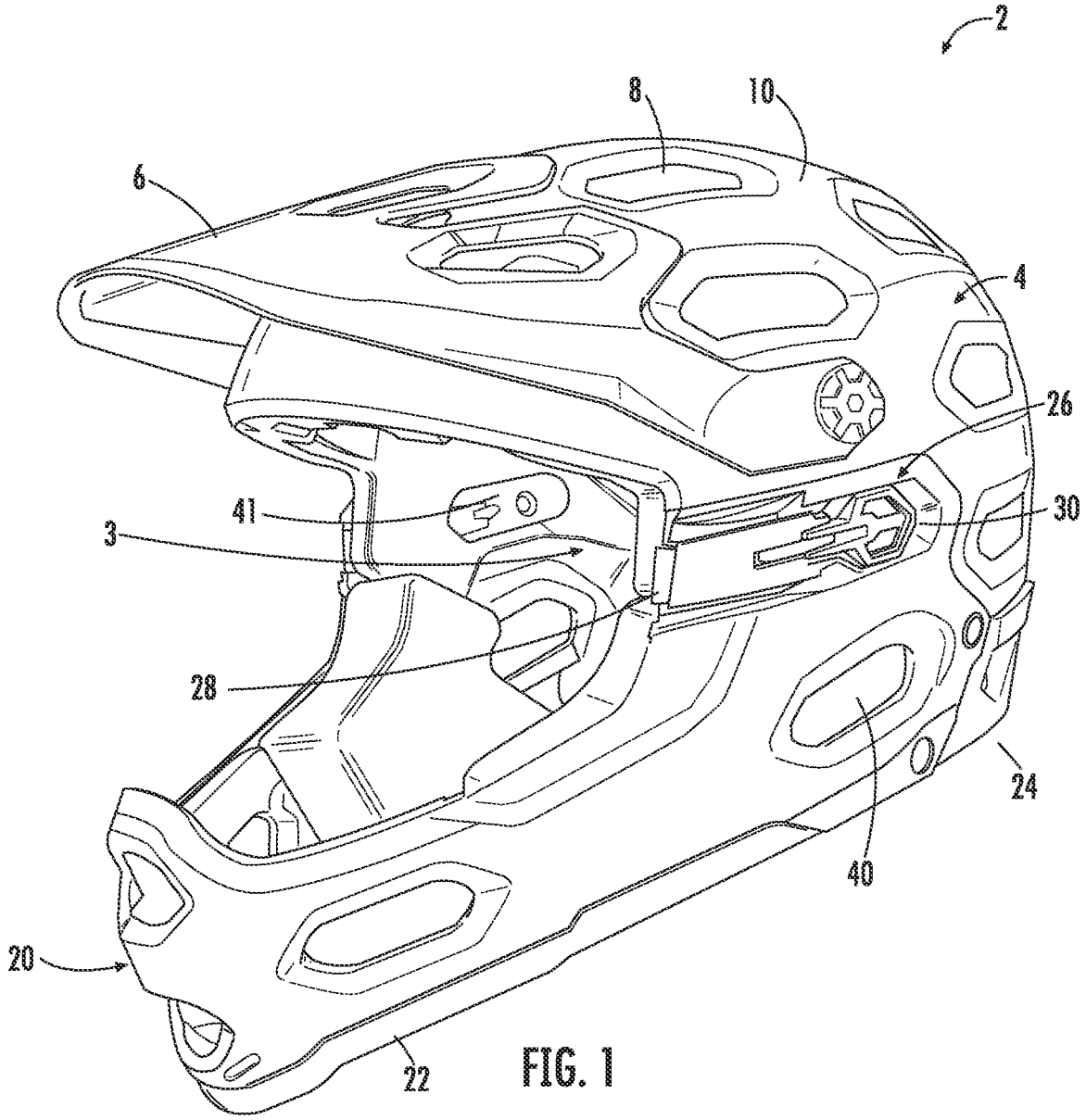
FIG. 1 is a side perspective view of a mountain biking helmet system.

FIG. 1 depicts a perspective view of a non-limiting embodiment of a mounting biking helmet system 2 comprising a chin bar 20 removably coupled circumferentially around a helmet 4. According to some aspects, a removable chin bar 20 allows a rider to wear a bike certified helmet 4, which is typically lighter and almost always more ventilated than a downhill certified helmet, and have the added protection of a chin bar 20 which can be easily removed for the uphill portions of an enduro event. In addition to easy removal, a chin bar 20 may also be easily placed back on the helmet 4 prior to the start of the timed downhill portion. According to some aspects, a chin bar 20 may be put on or taken off with the helmet 4 on the rider, meaning the rider is not required to take off the helmet 4 to remove or replace the chin bar 20. Some riders currently carry two helmets for an enduro race—a bike helmet for the uphill portions and a full-face helmet for the downhill. One or more embodiments of a mountain biking helmet system contemplated in this disclosure eliminate the need to carry two helmets for an enduro event.

In some embodiments, a removable chin bar 20 is a stand-alone component that can be adapted for use with bike certified helmets. In more particular embodiments, a removable chin bar 20 includes a helmet 4 that is specifically intended for use with removable chin bar 20 of the present disclosure. Such a helmet is preferably a bike certified helmet or a mountain bike certified helmet. According to some aspects, a helmet 4 comprises a plurality of vent holes 8 positioned around the helmet 4 and extending through the helmet 4. The vent holes 8 may be surrounded by an angled edge on an outer surface 10 of the helmet 4. In some embodiments, amongst the plurality of vent holes 8 may be one or more side vents and one or more alignment vents (shown in FIG. 4). As shall be described in greater detail below, the one or more side recesses 16 and the one or more alignment recesses 14 may be strategically positioned to correspond to one or more side buckles 26 and one or more alignment protrusions 38 on a chin bar 20. Embodiments of a helmet 4 may further comprise an open front 3 (FIG. 3), a visor 6 (FIG. 3), and/or helmet strap 5 (FIG. 4) as are commonly known in the art.

Figure 2:
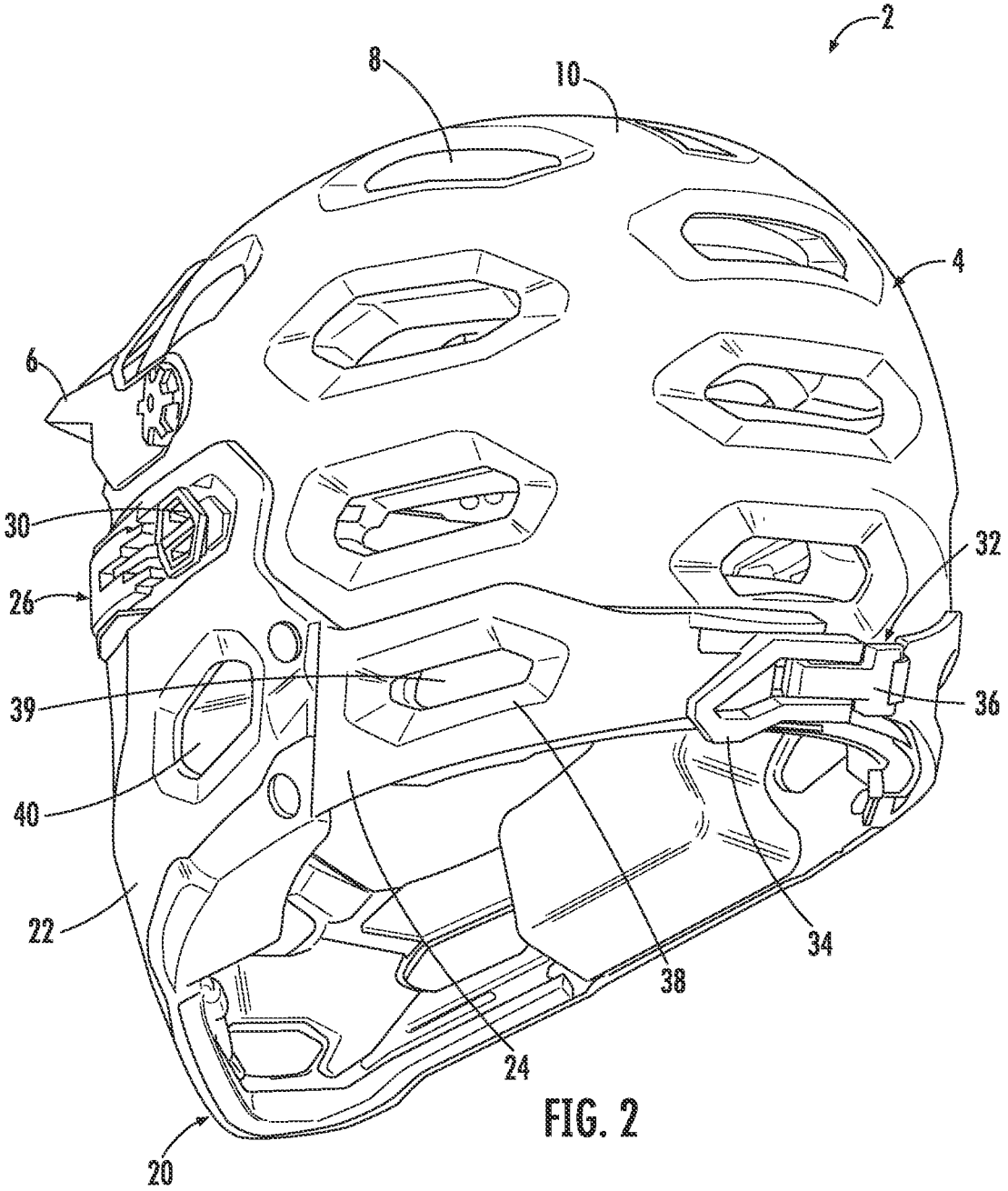
FIG. 2 is a rear perspective view of a mountain biking helmet system.

In one or more embodiments, a removable chin bar 20 removably couples circumferentially around a helmet 4. In more particular embodiments, such as the non-limiting embodiment depicted in FIG. 2, a removable chin bar 20 removably couples circumferentially to a bottom portion 17 of a helmet 4. However, a chin bar 20 does not have to wrap around the bottom portion 17 or base of the helmet 4. Alternatively, for example, the chin bar 20 could wrap around the helmet 4 at the "equator" of the helmet 4 or any place in between the top and bottom periphery at the back of the helmet 4. According to some aspects, a chin bar 20 comprises a front portion 22 and a back portion 24. The front portion 22 and the back portion may be coupled to one another or integrally formed as a single piece.

In one or more embodiments, a removable chin bar 20 comprises at least one rear coupling configured to reduce the circumference of the removable chin bar. In the non-limiting embodiment depicted in FIG. 2, the removable chin bar 20 comprises a rear buckle 32 configured to reduce the circumference of the removable chin bar 20 when in a closed position. The at least one rear buckle 32 is preferably located at the center of a back portion 24 of a removable chin bar 20. The rear buckle 32 is used to removably couple the removable chin bar 20 to the helmet 4. When the circumference of the removable chin bar 20 is reduced by closing the rear buckle 32, the chin bar 20 wraps around and is secured to the helmet 4. In other embodiments, the at least one rear coupling may comprise any coupling known in the art configured to reduce the circumference of the removable chin bar 20.

By circumferentially wrapping a chin bar 20 around a helmet 4, the chin bar is more resistant to deformation, and is more robust in terms of energy absorption and energy management than those designs previously used for removable chin bars that simply clip into a side portion of the helmet. Significantly, a force or side impact acting on a helmet is better absorbed and managed thereby offering better protection to the helmet wearer because the securely attached chin guard reduces rotation and movement of the chin bar with respect to the helmet.

According to some aspects, a chin bar 20 further comprises one or more side couplings. More particularly, a chin bar 20 may comprise one or more side buckles 26, as depicted in the non-limiting embodiment of FIGS. 1-3. In one or more embodiments, a side buckle 26 may lock into a side recess 16 in a helmet 4 to secure the chin bar 20 to a helmet 4. The side recess 16 may comprise any of a depression, channel, groove, vent, or other detail on the outer surface 10 of the helmet 4. In some embodiments the side recess 16 comprises a vent of a plurality of vents 8 on the helmet 4. Side buckles 26 may be used in alternative or addition to a rear buckle 32. A particular, non-limiting embodiment of how a side buckle 26 may be releasably coupled to a helmet 4 is discussed in greater detail below. Specifically, side buckles 26 or coupling a chin bar 20 to a helmet 4 at a position of a side recess 16 can lock chin bar 20 in a fore-aft direction to manage energy and prevent relative movement of the chin bar 20 during front impacts as well as side impacts.

Figure 3:
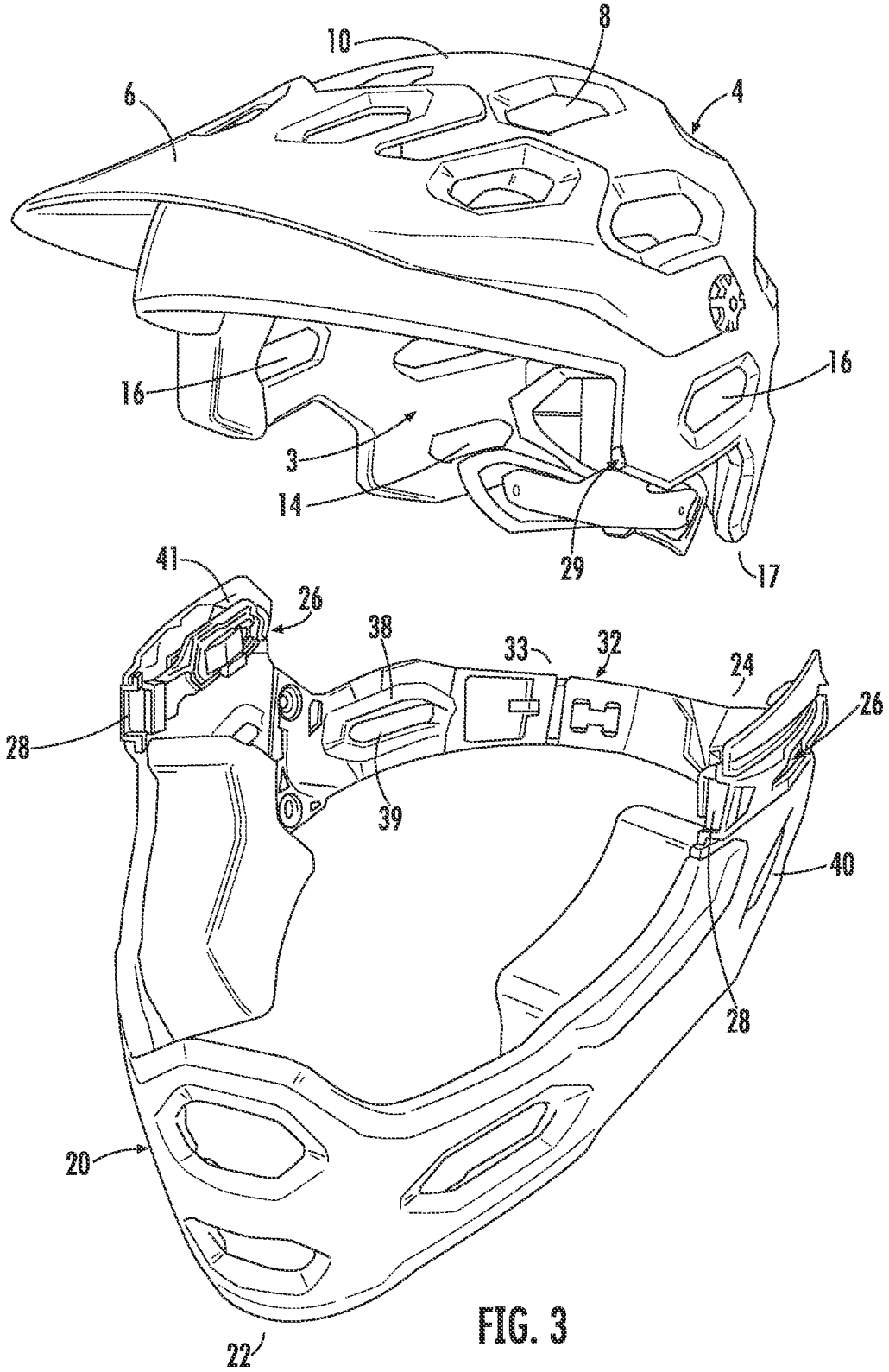
FIG. 3 is an exploded view of a mountain biking helmet system.

In addition to using buckles or other movable mechanical fasteners for securing a chin bar 20 to a helmet 4, other features, such as one or more alignment protrusions 38 or details may be utilized. FIG. 3 depicts a non-limiting embodiment of a helmet 4 separated from a non-limiting embodiment of a chin bar 20 comprising an alignment protrusion 38. An alignment protrusion 38 may provide a snug or secure fit by engagement to an alignment recess 14 and also reduce relative movement between a chin bar 20 removably coupled to a helmet 4. The alignment recess 14 may comprise any of a depression, channel, groove, vent, or other detail on the outer surface 10 of the helmet 4. In some embodiments the alignment recess 14 comprises a vent of a plurality of vents 8 on the helmet 4. This provides a more robust interface and interconnection between a helmet 4 and a chin bar 20. The alignment protrusion 38 does not rely on movable part to engage the chin bar 20 to the helmet 4, but instead relies on complementary or mating parts with substantially mirror images of each other to contact each other to provide a friction fit for maintaining a relative position between the helmet 4 and the chin bar 20. While one alignment protrusion 38 is shown with an alignment recess 14, any number of alignment protrusions 38 can be included along any portion of the helmet 4 according to the configuration and design of the helmet 4 and chin bar 20. Alignment and engagement between a chin bar 20 and a helmet 4 at a location of an alignment recess 14 helps in preventing vertical rotation of the chin bar, and protects against front top and front bottom impacts. It is further contemplated that the alignment protrusion may comprise teeth similar to those described in relation to a side buckle 26 and/or that the alignment protrusion 38 may comprise a buckle similar to that described in relation to the side buckle 26.

Figure 6:
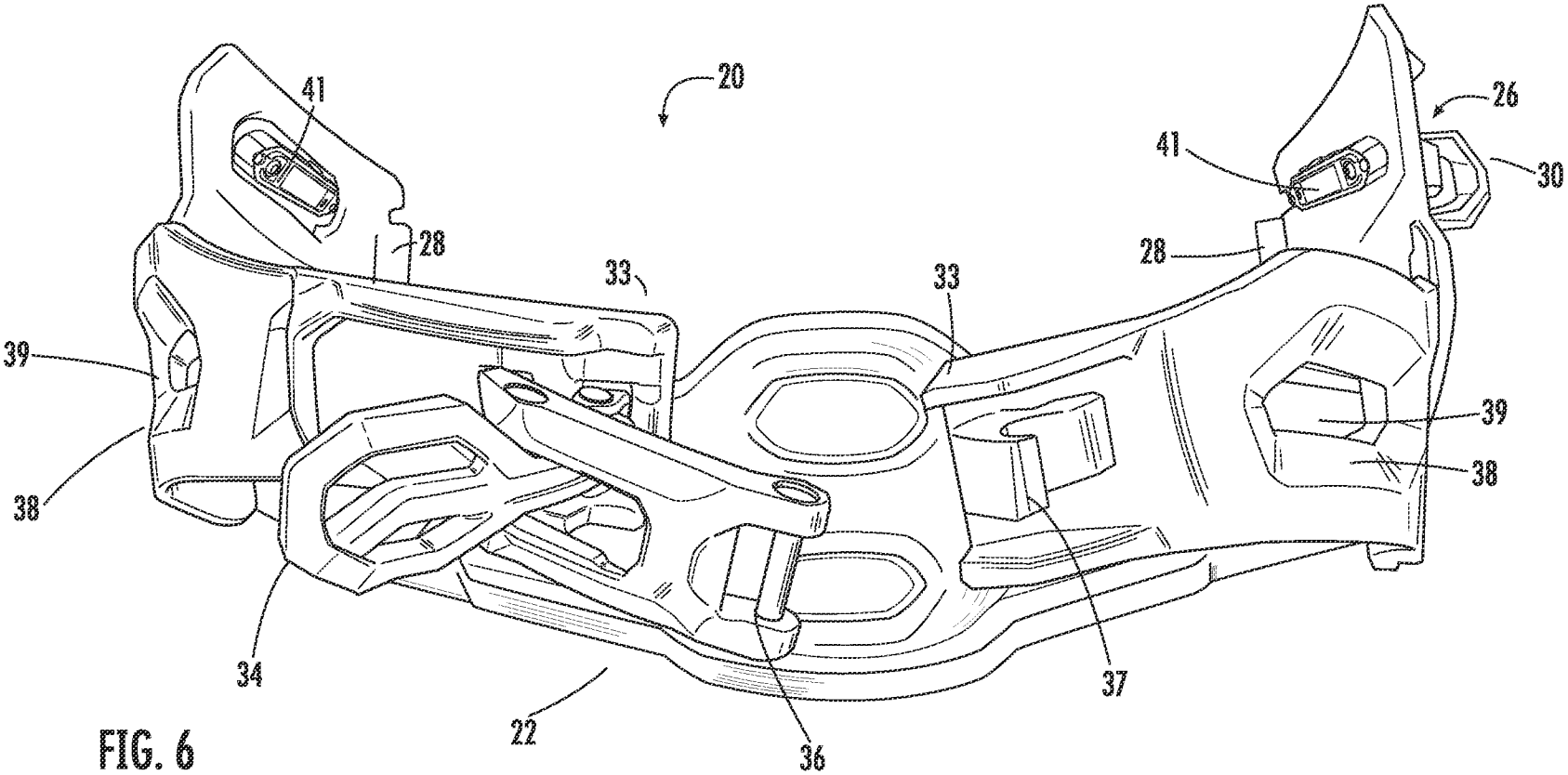
FIG. 6 is a rear view of a rear buckle of a chin bar in an open position.

Returning now to FIG. 2, a rear buckle 32 may be used to draw a back portion 24 of a removable chin bar 20 tight around a helmet 4 by moving opposing terminating ends 33 (shown in FIG. 6) or portions of the chin bar 4 past or adjacent each other to decrease a circumference of the chin bar 20 and to bring the chin bar 20 into snug contact with the helmet 4. FIG. 6 depicts a non-limiting embodiment of a rear buckle 32 of a chin bar 20 in an open position with the two terminating ends 33 separated from one another. According to some aspects, a rear buckle 34 comprises a lever 34 and a hook 36 coupled proximate a first terminating end 33 and a latch 37 proximate a second terminating end 33. In operation, the hook 36 engages with the latch 37, then the lever is pulled or pushed towards the chin bar 20 to tighten the chin bar 20 or decrease the circumference of the chin bar 20. Thus, according to some aspects, a rear buckle 32 secures a chin bar circumferentially around a perimeter of a helmet 4. As a result of the circumferential wrapping of the chin bar 20 around the helmet 4, the chin bar 20 may be substantially hoop-shaped in some embodiments. A hoop-shaped chin bar 20 is more resistant to deformation than other traditional U-shaped chin bars for particular impacts. A hoop-shaped chin bar 20 also better resists a wide variety of impacts (front top, front bottom, side, etc.).

In alternative embodiments, a circumference-reducing rear buckle 32 is not required. Instead, any device that secures a hoop-shaped chin bar to a helmet 4 could be utilized such that the chin bar 20 wraps circumferentially around the helmet 4 instead of merely plugging into the helmet as previously known in the art.

A chin bar 20 according to the present disclosure also provides a ventilation system for the user that is an improvement to the downhill certified helmets described in the background section above. In some implementations, the removable chin bar 20, like the helmet itself, has a plurality of vent holes 40 (shown in FIGS. 1 and 2). More particularly, a chin bar 4 may comprise two alignment vents 39 of the plurality of vent holes 40 proximate the two alignment protrusions 38 such that the alignment vents 39 of the chin bar 20 align with two alignment recesses 14 of the helmet 4 when the alignment protrusions 38 are engaged with the alignment recesses 14 of the helmet 4. Such a configuration facilitates positional coupling of the chin bar 20 the helmet 4.

With respect to vent holes 40 in a chin bar 20, vent holes 40 may be formed on both sides of the removable chin bar 20 and on the front end of the front portion 22 of the removable chin bar 20 such that they are directly in front of the user's face during use. However, they are preferably adjacent each other, one on top of the other. This configuration provides a taller chin bar 20 in front of the user's face while maintaining the ventilation system. In addition or alternative, some embodiments of a removable chin bar 20 comprise two vent holes 40 on each side.

Figure 5:
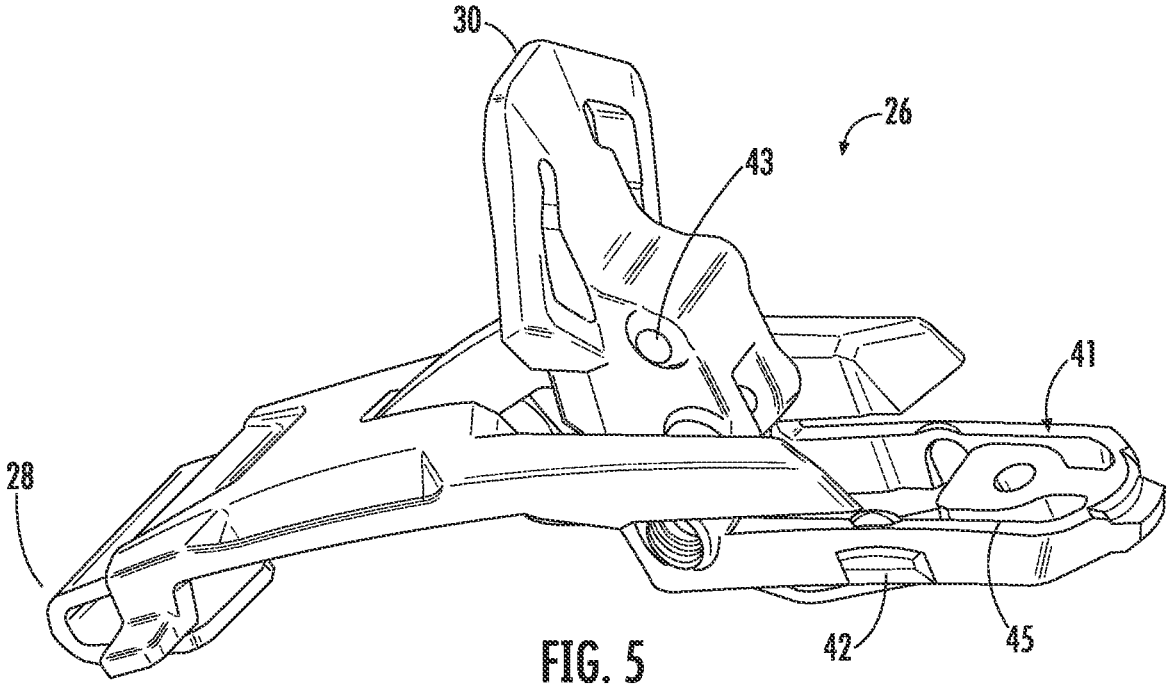
FIG. 5 is a side perspective view of a side buckle in an open position.

Other embodiments of a mountain biking helmet system 2 may comprise additional or alternative buckles or couplings to secure a chin bar 20 to other parts of a helmet 20. For example, as depicted in FIGS. 1 and 3, one or more vent holes 8 of the helmet 4 may be positioned for engagement with additional buckles, latches, couplings or other devices to more securely removably couple a chin bar 20 to the helmet 4. These additional points of attachment may be in addition to the circumferential coupling of a chin bar 20 around a perimeter of the helmet 4. A variety of buckles, latches, couplings or other devices may be used. FIG. 5 provides a view of a side buckle 26 in an open position and removed from the chin bar 20. The side buckles shown in the figures are for exemplary purposes only, and not limiting. Accordingly, an exemplary side buckle 26 is described in greater detail below, which can be beneficially employed for removably coupling a chin bar 20 to a helmet 4 as described above.

According to some aspects one or more side recesses 16 on a helmet 4 are configured to receive a buckle base 41 of a side buckle 26. A size, shape, and volume of the side recesses 16 may be sized to substantially or completely contain a volume of the side buckle 26 such that an aesthetic of the helmet 4 is not altered and an outer profile of the helmet 4 is not expanded to include protrusions extending from the helmet 4 which could interfere with helmet aerodynamics, wearability, or functionality of the helmet 4. Alternatively, a size of the side buckle 26 can be designed to fit substantially or completely within the side recess 16.

Figure 4:
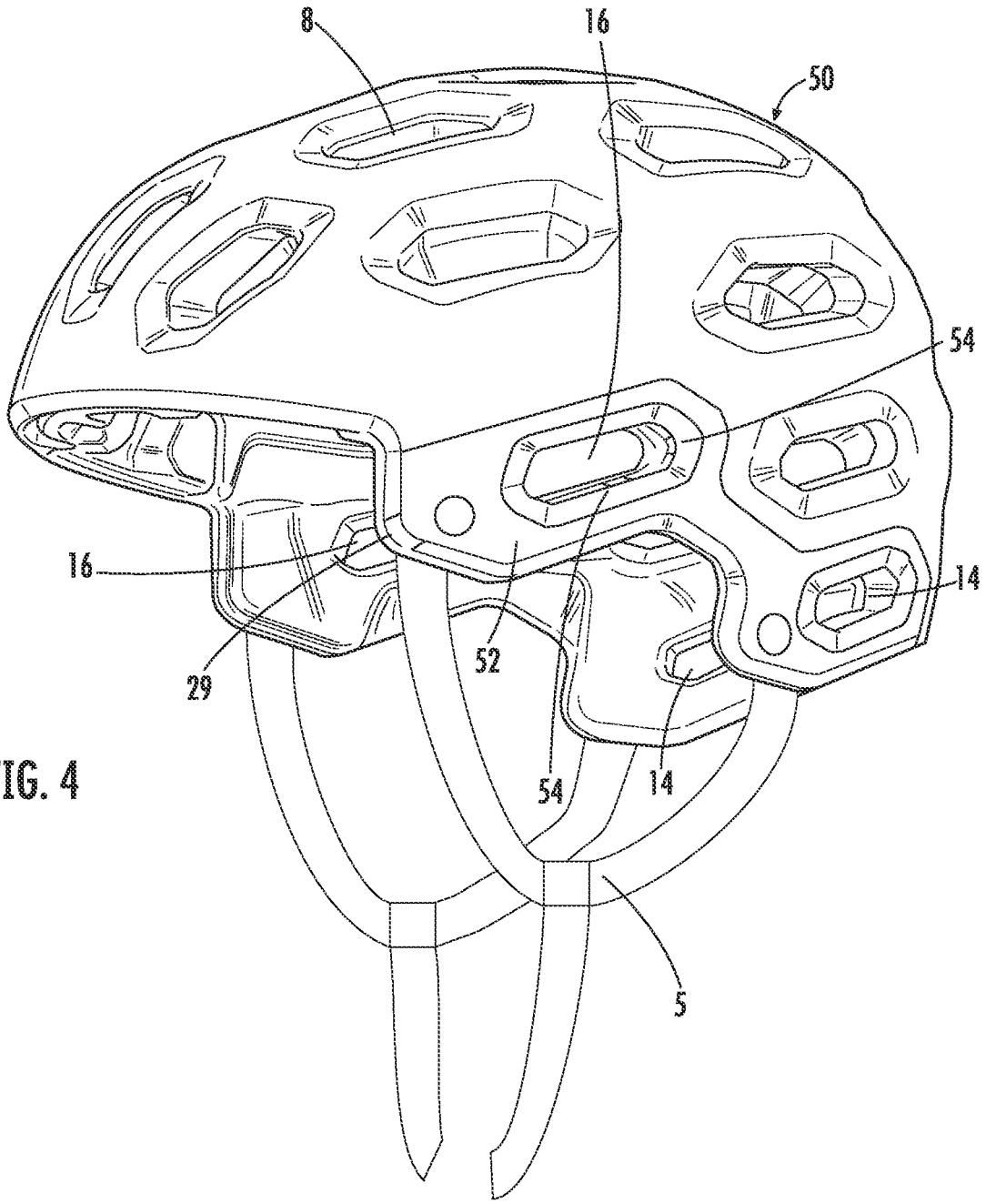
FIG. 4 is a side perspective view a mountain biking helmet.

One or more embodiments of a helmet 50 comprise an in-molded thermoplastic lower component 52 configured to provide added structure or a reinforced portion of the helmet 50. According to some aspects, the thermoplastic lower component 52 is positioned to surround one or more of the plurality of vent holes 8. More particularly, a thermoplastic lower component 52 may be positioned on an outer surface 10 of a helmet to surround a side recess 16 and an alignment recess 14 of the plurality of vent holes 8. FIG. 4 depicts a non-limiting embodiment of a helmet 50 comprise two thermoplastic lower components 52 (only one visible) each of the two thermoplastic lower components 52 surrounding a different side recess 16 and alignment recess 14.

As shown in FIG. 4, a number of reentrant openings, cavities, or voids, collectively referred to herein as tooth receivers 54 may be formed within helmet material bordering the side recess 16, such as an in-molded thermoplastic component 52, to receive or be coupled with one or more teeth 42 of a side buckle 26 partially disposed within the side recess 16. It is contemplated that the features described with respect to a helmet 50 depicted in FIG. 4 are applicable to other recesses 16 or vents in other helmets 4 as well as to other opening in other objects.

According to some aspects, a plurality of tooth receivers 54 are positioned in a helmet 4 proximate a side recess 16. More particularly a helmet 50 may comprise a front tooth receiver, a rear tooth receiver, and two side tooth receivers. A base 41 of a side buckle 26, as shown in FIG. 5, may comprise corresponding teeth 42 positioned to engage with the tooth receivers 54. By engaging in four tooth receivers 54, one tooth receiver being on each side of side recess 16, dual actuator side buckles 26 with motion and locking engagement in two opposing orthogonal directions can be accommodated and movement can be restrained with respect to at least three degrees of freedom, i.e. movement front-to-back, side-side, and in a direction orthogonal or transverse to the front-to-back and side-side directions. It is further contemplated that each alignment recess 14 may comprise similarly configured and positioned tooth receivers 54.

Additionally, a side buckle 26, as well as variations thereof, can also be beneficially employed for releasably coupling any desired article or accessory to the helmet, such as a camera mount, light, or other feature. By embedding a buckle within a helmet vent hole 8 or other similar aperture, articles and devices can be attached to the helmet with a minimal change or no aesthetic change to helmet. For example, when a chin bar 20 of a helmet 50 is off or is not attached, the aesthetic of the helmet 50 is substantially identical to a helmet that is not configured to receive a chin bar 20 using the buckles described herein. Similarly, when an accessory such as a chin bar 20 is attached to a helmet 50, an aesthetic of the helmet 50 is likewise not substantially affected because much, if not all, of the latching or attachment mechanism is submerged or contained within the side recess 16 of the helmet.

FIG. 5 depicts a non-limiting embodiment of a side buckle 26 removed from a chin bar 20 and in an open position. One or more embodiments of a side buckle 26 comprise a lever 30 that can be rotatably engaged to lock or unlock the side buckle 26 with respect to the helmet 50. With the lever 30 in an up or unlocked position, the side buckle 26 may be removed or inserted into a side recess 16 of a helmet 50. When the lever 30 is in its up position, a hook 28 has slid forward such that the hook is released from, and is not disposed within a front receiver 29 on the helmet 50.

According to some aspects, a lever 30 may comprise two protrusions 43 that push against two corresponding flexible beams 45 when the lever 30 is in its closed position (shown in FIG. 1). The flexible beams 45 can be portions of the buckle base 41 that are integrally formed with the base 41. Advantageously, the buckle base 41 and flexible beams 45 can be formed of a flexible engineering plastic that are moved, shifted, or displaced outwards when the protrusions 43 are in a closed position and press out against an inside surface of the flexible beams 45. When the flexible beams 45 are pushed outwards, the side teeth engage with the side tooth receivers of the side recess 16. Similarly, when the lever 30 is moved into its closed position, the side buckle 26 draws the hook 28 inwards to engage the front receiver 29 of the helmet 50. The base 41 of the side buckle 26 may further comprise a rear static tooth that can be pressed to snap into the rear tooth receiver. Additionally, the rear static tooth, like any of the teeth 42 may also be dynamic or spring loaded. When the lever 30 is a closed position, the two protrusions 43 on the lever 30 press out against the flexible beams 45 of the buckle base 41 and the hook 28 is drawn forward or inward into a front receiver 29 of the helmet 50. The flexible beams 45 of the buckle base 41 are moved, shifted, or displaced outwards into the side tooth receivers when the protrusions 43 are in a closed position and press out against an inside surface of the flexible beams 45.

By using a method similar to that employed by the side buckle 26, a helmet accessory, such as a chin bar 20 or other device, can be easily and reliably releasably coupled to the helmet. Additionally, the addition or removal of the accessory can be done using buckles and hooks without the additional time and effort required with obtaining and using tools as previously required.

Many of the various concepts and detailed descriptions provided herein do not include the full descriptions of the various components, so as to not obfuscate the disclosed inventions. Unless otherwise explained and excluded herein, it is intended that the embodiments and implementations disclosed herein may be used in combination with any relevant embodiments and implementations that would be known to a person of ordinary skill in the art.

What is claimed is:

1. A unitary chin bar configured to removably attach to a helmet, wherein the chin bar comprises a front portion and a back portion integrally formed as a single piece; and opposing terminating ends at the back portion thereof, a first side coupling, and a second side coupling opposite the first side coupling, each of the first and second side couplings comprising a base, a top and a lever rotatably engaged to the base and the top rotatably operable about an axis parallel to the base between an open position and a closed position, wherein the base is configured to releasably engage with the helmet at respective first and second side recesses of the helmet and the top is drawn toward the base when the lever is in the closed position;

wherein the chin bar is configured to wrap circumferentially around and overlap an outer surface of the helmet at a bottom rear of the helmet and extend forward of the helmet only at a bottom of an open front side of the helmet when the chin bar is attached to the helmet; and wherein the opposing terminating ends are configured to extend to the rear of the helmet and directly attach to each other through a rear coupling configured to tighten the chin bar circumferentially against the outer surface of the helmet in a closed position and configured to loosen the chin bar circumferentially against the outer surface of the helmet in an open position so that the chin bar is removable from the helmet while the helmet is worn by a mountain biker.

2. The chin bar of claim 1, wherein the rear coupling is further configured to attach the opposing terminating ends together in the closed position, and configured to release the opposing terminating ends from each other in the open position.

3. The chin bar of claim 1, wherein the rear coupling comprises a rear buckle.

4. The chin bar of claim 3 wherein the rear buckle comprises a lever and a hook operably coupled to the lever proximate a first terminating end of the chin bar wherein the hook is configured to releasably engage a latch proximate a second terminating end of the chin bar, wherein when the hook is engaged to the latch moving the lever from an open position to a closed position draws the first terminating end toward the second terminating end.

5. The chin bar of claim 1, wherein the rear coupling comprises a rear lever.

6. The chin bar of claim 1, wherein the first and second side couplings of the chin bar are first and second opposing side buckles each comprising the lever operable between an open position and a closed position, and wherein a portion of each of the first and second opposing side buckles is configured to engage a different one of the first and second side recesses on the helmet when the respective side buckle is in a closed position to couple the chin bar circumferentially around the helmet.

7. The chin bar of claim 6, wherein in each of the first and second opposing side buckles further comprises a hook connected to the top of each of the side couplings configured to engage within a different front receiver of a helmet comprising two front receivers separate from and proximate to the two side recesses when the respective buckle is in the closed position.

8. The chin bar of claim 7, wherein the chin bar further comprises two alignment protrusions configured to engage with two alignment recesses on the helmet.

9. A unitary chin bar configured to removably attach to a helmet having an outer surface, an open front side, and first and second side recesses on respective left and right sides of the helmet and first and second front receivers on respective left and right sides separate from and proximate to each of the respective first and second side recesses of the helmet, wherein the chin bar is configured to cover a portion of the open front side of the helmet and comprises a front portion and back portion integrally formed as a single piece; and opposing terminating ends at the back portion thereof configured to wrap around and overlap the outer surface of the helmet only along a bottom rear of the helmet, the chin bar further comprising a buckle on each side of the chin bar, each buckle comprising a buckle base sized to fit within the respective first and second side recesses on opposing sides of the helmet and a top configured to be drawn toward the base in a closed position and moved away from the base in an open position, wherein each buckle is configured to engage the chin bar to the helmet in the closed position, and release the chin bar from engagement with the helmet in the open position;

wherein each buckle further comprises a buckle lever movable about an axis parallel to the base between the open position and the closed position;

wherein the chin bar further comprises a rear coupling at the opposing terminating ends of the chin bar, the rear coupling directly attaching the opposing terminating ends of the chin bar to each other and operable between an open position and a closed position that reduces the circumference of the chin bar and tightens the chin bar circumferentially against the outer surface of the helmet.

10. The chin bar of claim 9, wherein each of the buckles further comprises a hook connected to the top of each buckle operably coupled to the buckle lever such that movement of the buckle lever from the open position to the closed position draws the hook closer to the base, the hook being configured to engage within a corresponding front receiver on the helmet when the buckle lever is in the closed position.

11. The chin bar of claim 9, wherein the chin bar is configured to extend forward of the helmet at a bottom of the open front side when the chin bar is attached to the helmet.

12. The chin bar of claim 9, wherein the rear coupling is further configured to attach the opposing terminating ends together in the closed position, and configured to release the opposing terminating ends from each other in the open position.

13. The chin bar of claim 9, wherein the rear coupling is configured to tighten the chin bar circumferentially against the outer surface of the helmet in a closed position and configured to loosen the chin bar circumferentially against the outer surface of the helmet in an open position so that the chin bar is removable from the helmet while the helmet is worn by a mountain biker.

14. The chin bar of claim 9, wherein the rear coupling comprises a rear buckle.

15. The chin bar of claim 14 wherein the rear buckle comprises a lever and a hook operably coupled to the lever proximate a first terminating end of the chin bar wherein the hook is configured to releasably engage a latch proximate a second terminating end of the chin bar, wherein when the hook is engaged to the latch moving the lever from an open position to a closed position draws the first terminating end toward the second terminating end.

16. The chin bar of claim 9, wherein the rear coupling comprises a rear lever.

* * * * *